US009320932B2

(12) United States Patent
Newman

(10) Patent No.: US 9,320,932 B2
(45) Date of Patent: Apr. 26, 2016

(54) EXERCISE JUMP ROPE

(71) Applicant: David R. Newman, El Cajon, CA (US)

(72) Inventor: David R. Newman, El Cajon, CA (US)

( * ) Notice: Subject to any disclaimer, the term of this patent is extended or adjusted under 35 U.S.C. 154(b) by 199 days.

(21) Appl. No.: 14/067,657

(22) Filed: Oct. 30, 2013

(65) Prior Publication Data

US 2015/0119206 A1 Apr. 30, 2015

(51) Int. Cl.
*A63B 5/20* (2006.01)

(52) U.S. Cl.
CPC ..... *A63B 5/20* (2013.01); *A63B 2210/50* (2013.01)

(58) Field of Classification Search
CPC ..... A63B 5/20; A63B 5/22; A63B 5/205; A63B 21/0557
See application file for complete search history.

(56) References Cited

U.S. PATENT DOCUMENTS

| | | | | |
|---|---|---|---|---|
| 4,093,211 | A | 6/1978 | Hughes et al. | |
| 4,158,457 | A | 6/1979 | Hydro | |
| 4,281,832 | A | 8/1981 | Quinby, Jr. | |
| 4,330,118 | A | 5/1982 | Race | |
| 5,071,118 | A | 12/1991 | Barnett | |
| 5,478,297 | A | 12/1995 | Dennis, Jr. | |
| 5,697,871 | A | 12/1997 | Landfair | |
| 5,749,812 | A | 5/1998 | Feciura et al. | |
| 6,440,043 | B1 * | 8/2002 | LaCoste | 482/82 |
| 6,551,222 | B1 | 4/2003 | Beaver | |
| 6,736,763 | B1 | 5/2004 | Hsu | |
| 6,752,746 | B1 | 6/2004 | Winkler et al. | |
| 7,341,544 | B2 | 3/2008 | St. George et al. | |
| 7,789,809 | B2 | 9/2010 | Borth et al. | |
| 7,794,369 | B1 | 9/2010 | Rivera, III | |
| 8,075,455 | B2 | 12/2011 | Gamboa et al. | |
| 2004/0002408 | A1 | 1/2004 | Rigas | |
| 2006/0035761 | A1 | 2/2006 | Saint George et al. | |
| 2007/0191194 | A1 | 8/2007 | Joy et al. | |
| 2010/0160116 | A1 | 6/2010 | LaTour | |
| 2010/0240501 | A1 | 9/2010 | Joy et al. | |
| 2011/0306474 | A1 | 12/2011 | Gamboa et al. | |
| 2013/0040786 | A1 | 2/2013 | Heinrich | |
| 2013/0165299 | A1 * | 6/2013 | Hunt | A63B 5/20 482/82 |

FOREIGN PATENT DOCUMENTS

KR 10-0340237 B1 6/2002

OTHER PUBLICATIONS gofit.net, "Jump Ropes." https://web.archive.org/web/20120306170106/http://store.gofit.net/category-s/26.htm. Available online on Mar. 6, 2012; retrieved on May 21, 2014.

gofit.net, "Jump Ropes." https://web.archive.org/web/20120303053741/http://store.gofit.net/category-s/26.htm. Available online on Mar. 3, 2012; retrieved on May 21, 2014.

International Search Report and Written Opinion for related PCT application No. PCT/US2014/061238, mailed on Jan. 15, 2015, in 16 pages.

* cited by examiner

*Primary Examiner* — Loan H Thanh
*Assistant Examiner* — Rae Fischer
(74) *Attorney, Agent, or Firm* — Procopio, Cory, Hargreaves & Savitch LLP

(57) ABSTRACT

Apparatus and methods for an exercise jump rope are disclosed herein. According to one aspect, the exercise jump rope comprises a cable assembly including a cable, a first and a second end attachment at a first end and a second end of the cable, respectively, and a first and a second cable connector coupled to the first and the second end attachment, respectively. The exercise jump rope further comprises a first and a second handle assembly coupled to the first and the second cable connector, respectively, each handle assembly including a hollow handle and a swivel assembly, each swivel assembly including a bearing fixed to the hollow handle, an axis pin having a head and a cross-hole and rotatably coupled to the bearing, an axis pin positioner configured to position a majority of the axis pin within the hollow handle.

22 Claims, 3 Drawing Sheets

EXERCISE JUMP ROPE

BACKGROUND OF THE INVENTION (1) Field of the Invention

The present disclosure generally pertains to handheld jump ropes, and is more particularly directed toward a high performance exercise jump rope.

(2) Description of Related Art

In the game of skipping one or more participants jump over a rope swung so that it passes under their feet and over their heads. The primary tool used in skipping is a jump rope (American English) or skipping rope (British English) (hereinafter "jump rope"). Generally, the jump rope is merely a rope suspended by two handles (one at each end).

Skipping is also an aerobic exercise that may be used for a cardiovascular workout. In particular, rope skipping is frequently used by athletes targeting peak performance, and is an important exercise in the area of cross fitness. For example, a double under is a popular exercise done on a jump rope in which the rope makes two passes per jump instead of just one. It is significantly more effective than a single rope pass in that it allows for higher work capacity. Rope control and the coordination of the athlete's jumps to the whipping of the wrist is the main key to double under success. However, jump rope consistency is the key to rope control. Moreover, the key to jump rope consistency is eliminating as many variables as possible.

In transitioning from a children's game to a high performance exercise, many improvements are desired in the equipment used. For example, most jump ropes on the market are too light, too flexible or too cheaply made, leading to poor performance and product inconsistency. Moreover, inferior materials and design combined with ever increasing use and intensity, may lead to early wear and variability over time. While some incremental improvements to the basic jump rope have been made in isolation, a high performance exercise jump rope remains elusive, despite their widespread use.

U.S. Pat. No. 5,749,812 issued to Feciura, et al. on May 12, 1998, shows a speed jump rope ball-bearing swivel attachment. In particular, the disclosure of Feciura, et al. is directed toward the application of a specific ball-bearing swivel which houses several ball-bearings, between the handles and rope material of a jump rope including a threaded member on the cap end and an O-ring on the spindle end to virtually eliminate the friction and drag associated with a conventional jump rope and allow free rotation of the jump rope material while attached to the handles.

U.S. Pat. No. 7,789,809 issued to Borth, et al. on, Sep. 7, 2010, shows a jump rope system. In particular, the disclosure of Borth, et al. is directed toward a jump rope which provides a pair of handles each handle providing a shaft coaxially rotatably engaged to a first bearing element and a second bearing element which attaches to a corresponding one of the opposed ends of a cable means.

U.S. Pat. App. Pub. No. 2013/0165299 by Hunt, published on Jun. 27, 2013, shows a jump rope device comprising a removably-connected cable. In particular, the disclosure of Hunt is directed toward jump rope devices which allow for the quick and easy interchanging of a cable of varying weight and length from handles configured to provide smooth rotation of such cables at both low and high speeds are disclosed. Devices in accordance with the disclosure may comprise a ball bearing assembly configured to facilitate 360-degree rotation of the cable. In an aspect, the handle of such jump rope devices is comprised of a ball bearing portion which enables both speed of rotational movement for a plurality of relatively lighter cables, and strength and durability for a plurality of relatively heavier cables. Handles may further comprise a snap hook assembly configured to facilitate rapid interchanging of cables.

The present disclosure is directed toward overcoming known problems and/or problems discovered by the inventor. In addition, other features and advantages will become more readily apparent to those of ordinary skill in the art after reviewing the following detailed description and accompanying drawings.

BRIEF SUMMARY OF THE INVENTION

An exercise jump rope is disclosed herein. The exercise jump rope comprises a cable assembly including a cable, a first and a second end attachment at a first end and a second end of the cable, respectively, and a first and a second cable connector coupled to the first and the second end attachment, respectively. The exercise jump rope further comprises a first and a second handle assembly coupled to the first and the second cable connector, respectively, each handle assembly including a hollow handle and a swivel assembly, each swivel assembly including a bearing fixed to the hollow handle, an axis pin having a head and a cross-hole and rotatably coupled to the bearing, an axis pin positioner configured to position a majority of the axis pin within the hollow handle.

According to one embodiment, a handle assembly for an exercise jump rope is also disclosed herein. The handle assembly comprises a hollow handle, a bearing fixed to the hollow handle, an axis pin having a head at one end and a cross-hole proximate an opposite end, the axis pin rotatably coupled to the bearing, an axis pin positioner configured to position a majority of the axis pin within the hollow handle, and an external spacer about the axis pin abutting an external face of the bearing.

BRIEF DESCRIPTION OF THE DRAWINGS

The accompanying drawings, which are incorporated in and constitute a part of the specification, illustrate embodiments of the invention, and together with the description, serve to explain the objects, advantages, and principles of the invention. In the drawings.

DETAILED DESCRIPTION OF INVENTION

The present disclosure generally relates to a jump rope that is fast, functional and durable. Embodiments provide a high performance exercise jump rope having a variety of improvements that have been found to increase performance and reduce variability. Here, the exercise jump rope is a covered cable, suspended by swivel mechanisms mounted to opposing handles.

After reading this description it will become apparent to one skilled in the art how to implement the invention in various alternative embodiments and alternative applications. However, all the various embodiments of the present invention will be described herein, it is understood that these embodiments are presented by way of an example only, and not limitation. As such, this detailed description of various alternative embodiments should not be construed to limit the scope or breadth of the present invention as set forth below.

Figure 1:
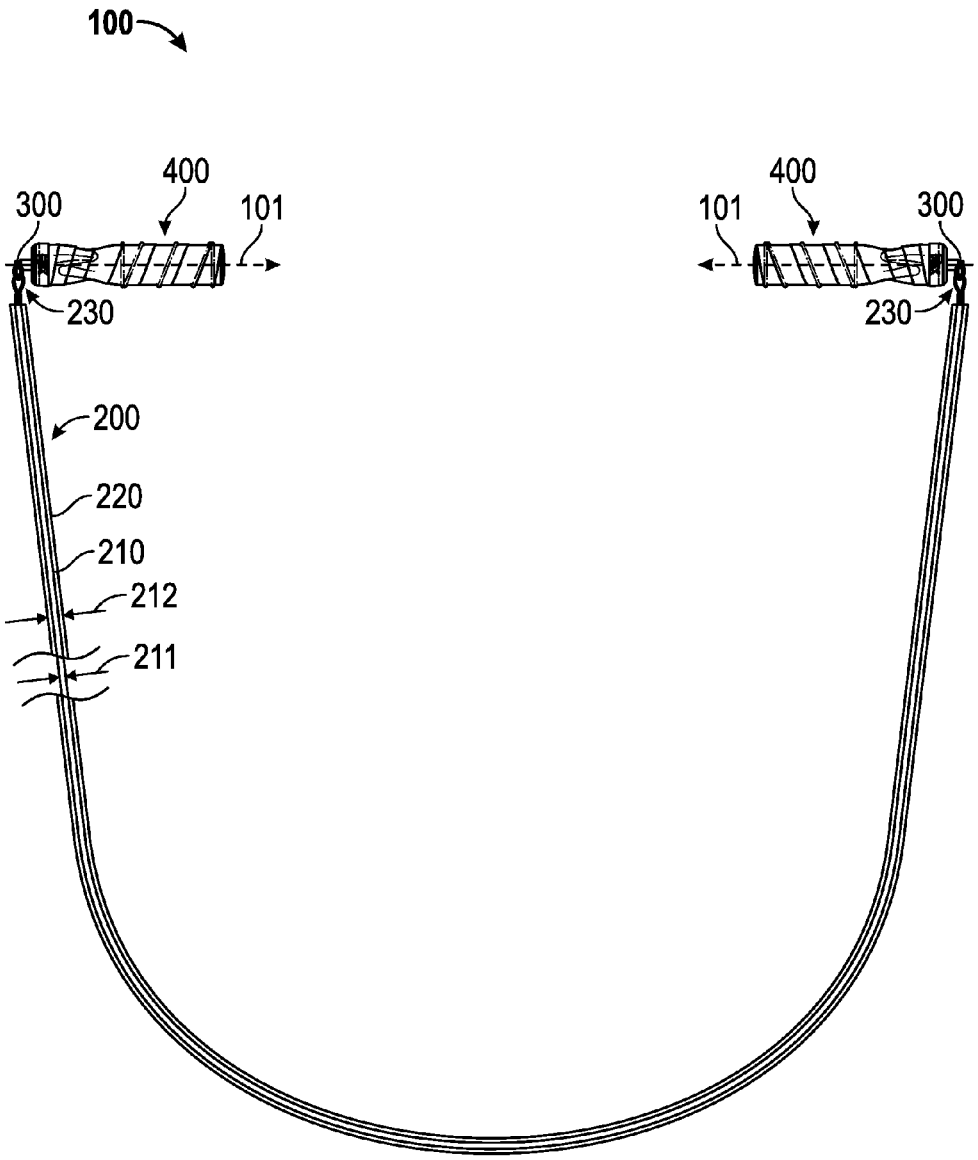
FIG. 1 shows an exemplary exercise jump rope.

FIG. 1 shows an exemplary exercise jump rope 100. The exercise jump rope 100 includes a cable assembly 200, two cable connectors 300, and two handle assemblies 400. Each handle assembly 400 is coupled to a separate end of the cable assembly 200. In addition, each end of the cable assembly 200 is free to rotate about its respective center axis. The cable connector 300 acts as an additional hinge joint between the handle assembly 400 and the cable assembly 200. This allows for greater mobility of the cable assembly 200 through the rotational movement around the user.

For reference, each handle assembly 400 may include an inward direction 101 along its center axis. As illustrated, the inward direction 101 is opposite the side where the cable assembly 200 is attached. Similarly, each handle assembly 400 may include an outward direction along the center axis and opposite the inward direction 101. In addition, this disclosure may refer to an inner region within each handle assembly 400, which is independent of the inward direction 101 and the outward direction. Also, certain features may be modified or exaggerated for convenience and/or illustration. For example, a middle section of the cable assembly 200 is truncated. Also for example, certain dimensions of the cable assembly 200 are exaggerated.

The cable assembly 200 includes a cable 210, a cover 220, and an end attachment 230 at each end. The cable 210 may be a wire rope of varying in material, construction, and weights. For example, cable 210 may be a steel cable such as aircraft cable steel wire rope. Also for example, the cable 210 may be constructed as 1×19 or 7×7 stainless steel cable. Also for example, and as discussed below, the cable 210 may be a PVC coated 1×19 stainless steel cable approximately (e.g., +/−10%) between 1.3 ounces to 1.8 ounces for a 9 foot length. Also for example, and as discussed below, the cable 210 may have a unit weight between 2.6 ounces and 8.6 ounces for a 9 foot length. Also for example, the cable assembly 200 may include a cover 220 about the cable 210 (e.g., PVC coating), where cover 220 extends between the first and the second end attachments 230. The cable 210 comes in at least six weights which include 1.3, 1.8, 2.6, 3.4, 4.1 and 8.6 ounces, however in alternative embodiments different weights ranging between 1.0 and 10 ounces could be used.

Also, selection of the length, weight and construction of the cable 210 may depend on several variables. In particular, the selection of the cable 210 may depend on the height and skill level of the user, the exercise desired, and the qualities of the cable in the particular configuration. For example, the cable 210 length may be measured directly against the user, or may be approximated by a length that is 3 feet plus the height of the user. Also for example, a faster exercise jump rope might not be recommended for beginners.

Independent of the user, the exercise jump rope 100 may be made for different uses and exercises. In particular, exercise jump rope 100 may be configured differently by varying the weight class or unit weight of the cable 210. For example, depending on the configuration of the cable assembly 200, the disclosed exercise jump rope 100 may also be adaped for or reconfigured for a variety of purposes. For convenience, the unit weight may be measured per 9 foot length of the cable 210 between the handle assemblies 400. Also, as discussed below, the cable connectors 300 (or portions thereof) may be integrated into the cable 210, but will be of relatively nominal added weight. Where this is not the case, the following configurations and cable weights may further exclude the cable connectors 300.

According to one embodiment, the cable assembly 200 may be may adapted as a "speed rope", comparable to traditional speed cables. In particular, the cable 210 may be approximately 1.3 ounces for a 9 foot length (excluding the handle assemblies 400), and produces a fast cycle rate. In this configuration, the inventor has discovered that a 1×19 strand construction created a more rigid cable. The rigid cable maintains shape much better creating a better opening for the athlete to jump through. A more flexible cable can collapse when speed diminishes making it more difficult to hop through. Alternately, a 7×7 strand construction may be used. In this embodiment, the cable assembly 200 may have an inside diameter (ID) 211 (i.e., the cable 210 only) of 1/16 inch (1.6 mm) and an outside diameter (OD) 212 (i.e., including the cover 220) of 3/32 inch (2.4 mm). This weight of cable may be ideal for users with high level coordination and quick twitch muscle fiber. The cycle rate may be much higher, producing elevated heart rate and improved fitness According to another embodiment, the cable assembly 200 may be may adapted as a "hybrid speed cable", due to its light nature while offering more feedback to the athlete. In particular, the cable 210 may be approximately 1.8 ounces for a 9 foot length (excluding the handle assemblies 400). The increased resistance allows the athlete to turn the exercise jump rope at a slightly slower cycle rate than the "fast rope", yet "triple unders" (where the rope passes under the user three times in a single jump) are still plentiful. As above, in this configuration, the inventor has discovered that a 1×19 strand construction created a more rigid cable. Alternately, a 7×7 strand construction may be used. In this embodiment, the cable assembly 200 may have an ID 211 of 1/16 inch (1.6 mm) and an OD 212 of 1/8 inch (3.2 mm). This weight of cable allows for elevated heart rate with slightly added resistance. The added resistance may promote improved control and awareness.

According to another embodiment, the cable assembly 200 may be may adapted as an all-around "utility cable". In particular, the cable 210 may be approximately 2.6 ounces for a 9 foot length (excluding the handle assemblies 400). This configuration, as a mid-range weighted cable, offers a nice blend of light weight with increased feedback and response while its rigidity maintains a nice "horse shoe" shape while in motion. In this configuration, a 7×7 strand construction may be used. In this embodiment, the cable assembly 200 may have an ID 211 of 5/64 inch (2.0 mm) and an OD 212 of 9/64 inch (3.7 mm). This variation of cable variation allows the most versatility with jumping styles. Boxers and fighters find this rope adapts well to the crossover and figure eight movements associated with that style of jumping. Likewise, fitness enthusiasts find it to have excellent control and feedback to the user which may promote sustained jumping sessions hence improving fitness.

According to another embodiment, the cable assembly 200 may be may adapted as a "weighted exercise cable". In particular, the cable 210 may be approximately 3.4 ounces for a 9 foot length (excluding the handle assemblies 400). This configuration offers tremendous feedback allowing the athlete to jump with a broader range of tempos from very slow to super-fast. In this configuration, a 7×7 strand construction may be used. In this embodiment, the cable assembly 200 may have an ID 211 of 3/32 inch (2.4 mm) and an OD 212 of 5/32 inch (4.0 mm). This cable variation may be useful to perform all of the styles of jumping associated with the lighter cables, however, the increased resistance promotes greater muscle fatigue and increases muscle stamina.

According to another embodiment, the cable assembly 200 may be may adapted as a "heavy cable". In particular, the cable 210 may be approximately 4.1 ounces for a 9 foot length (excluding the handle assemblies 400). This configuration provides for high intensity training, and may be desired by bigger, stronger athletes needing more resistance and feedback than most typical jump ropes provide. In this configuration, a 7×7 strand construction may be used. In this embodiment, the cable assembly 200 may have an ID 211 of 3/32 inch (2.4 mm) and an OD 212 of 3/16 inch (4.76 mm). This variation of cable begins to blend the disciplines of heavy resistance training with aerobic training. The user may feel an increased response of muscle fatigue as well as elevated heart rate with this embodiment.

According to another embodiment, the cable assembly 200 may be may adapted as an "extreme cable". In particular, the cable 210 may be approximately 8.6 ounces for a 9 foot length (excluding the handle assemblies 400). This configuration provides for even higher intensity training, offering tremendous resistance while still allowing the athlete to perform high aerobic activities such as double unders. The increased resistance creates a more intense muscle stimulus during use, which results in muscle fatigue as well as increased heart rate. In this configuration, a 7×7 strand construction may be used. In this embodiment, the cable assembly 200 may have an ID 211 of 5/32 inch (4.0 mm) and an OD 212 of 7/32 inch (5.6 mm).

According to one embodiment the cable connectors 300 may be quick release connectors. In particular, the cable connector 300 may include user-release mechanism such that the handle assemblies 400 may be detached from the cable assembly 200 without the use of tools. For example, as illustrated, the cable connector 300 may be conveniently embodied as a split ring, similar to a key ring, or the like. According to one embodiment, the cable connector 300 will have a symmetric geometry and/or a uniform weight distribution, minimizing vibration and other disturbances to smooth rotation of the cable assembly 200. According to another embodiment, the cable connector 300 may be a nickel plated split ring having an inside diameter of approximately 3/8 inch (9.6 mm) and an outside diameter of approximately 1/2 inch (12.3 mm).

According to an alternate embodiment, the cable assembly 200 may be coupled directly to the handle assembly 400. In particular, a similar mechanism can be achieved by eliminating the quick release attachment, and coupling the cable assembly 200 directly to a rotating member of the handle assembly 400. This may still garner most of the benefit of the rotational axis of the handle assembly 400 spinning in the handles, but would reduce the freedom of the cable at the attachment point.

In addition, one or more features of the cable assembly 200 may be integrated together. In particular, the cover 220 may be integrated with the cable. For example the cable may be aircraft grade steel cable coated with PVC, nylon, or a similar material. The PVC coating does not retain memory and therefore uncoils nicely. Alternately, the cover 220 may be an independent sleeve slid onto the cable 210, and may be subsequently secured in place.

The length of the stripped cable used to form the loop 231 has very specific ramifications in the efficiency of the linkage assembly. The inventor has discovered that varying degrees of length of the stripped portion of cable can result in a loop that, if to long, stretches and increases the length of the overall cord or if to short can cause binding between the looped section 231 and the split ring 300. The inventor has derived that a preferred length of the stripped portion of bare cable (prior to looping) is approximately 2 1/4 inch on the lighter cables (1/16 inch-5/64 inch ID). Similarly, the preferred length of stripped portion of bare cable (prior to looping) is 2 3/4 inch on the heavier cables (3/32 inch ID and above).

Similarly, the end attachment 230 may be integrated with the cable 210. In particular, the end attachment 230 may be, at least partially, formed from the cable 210 itself. For example the end attachment 230 may include a loop 231 formed from the cable 210, where the termination of the cable 210 is crimped onto the cable 210 with a swage 232. Thus, the first and the second end attachments 230 are swaged loops 231 including portions of the first end and the second end of the cable 210, respectively. Other integrated end attachments 230 are contemplated. Alternately, the end attachment 230 may be an independent component fixed to the end of the cable 210.

Figure 2:
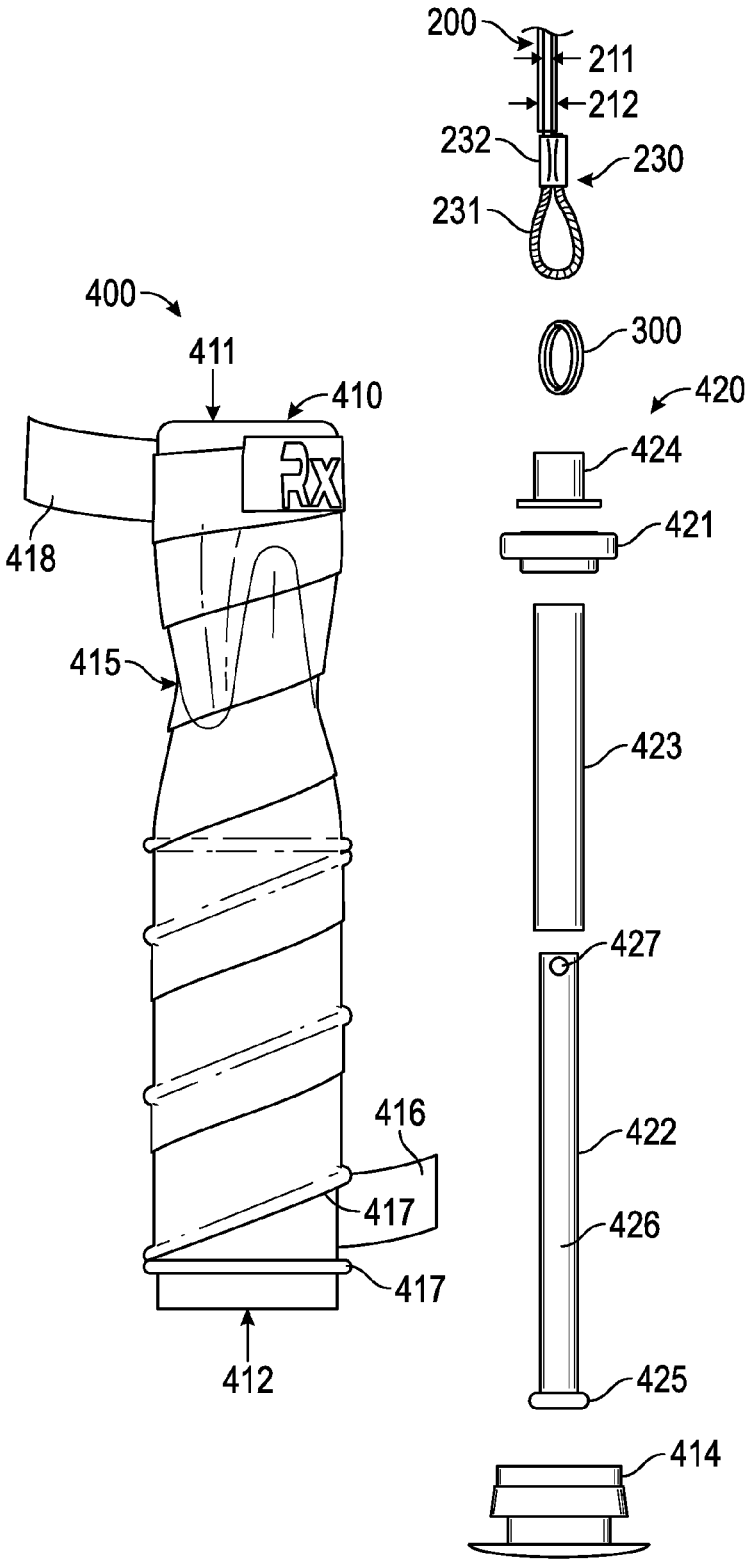
FIG. 2 is a side view of a disassembled handle assembly of the exercise jump rope of FIG. 1.
Figure 3:
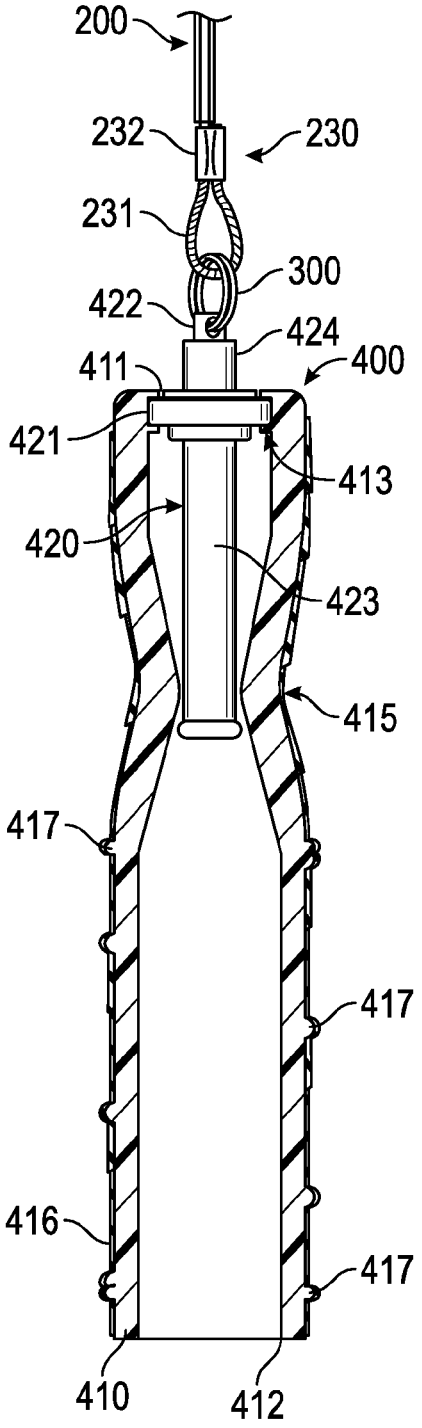
FIG. 3 is a cutaway side view of an assembled handle assembly of the exercise jump rope of FIG. 1.

Referring to FIG. 2 and FIG. 3, FIG. 2 is a side view of a disassembled handle assembly of the exercise jump rope of FIG. 1. In particular, inner components of the handle assembly 400 are displayed for reference. In addition, one end of the cable assembly 200 and one cable connector 300 are also included for reference. FIG. 3 is a cutaway side view of an assembled handle assembly of the exercise jump rope of FIG. 1. In particular, the handle is cut away to expose the swivel mechanism and its installation.

The handle assembly 400 includes a hollow handle 410 and a swivel assembly 420. In particular, the hollow handle 410 is configured to house the swivel assembly 420 and to interface with the athlete. In addition, the swivel assembly 420 is fixed to the hollow handle 410 and rotatably coupled to the cable assembly 200.

The hollow handle 410 is an elongate, hollow, structural member having an inward end opening 411, an outward end opening 412, and a bearing interface 413. The inward end opening 411 is configured to provide access to the swivel assembly 420 after installation, and the outward end opening 412 is configured to permit a rotating portion of the swivel assembly 420 to extend out from the hollow handle 410. According to one embodiment, the hollow handle 410 may made of molded PVC, and have an axial length of approximately 5 3/8 inches (25.4 mm), an inside diameter of approximately 3/4 inch (19 mm), and an outside diameter of approximately 1 inch (25.4 mm). The hollow handle 410 may further include an end cap 414 installed in the inward end opening 411 that is readily removable. Alternately, the end cap 414 may be fixed in place.

Structurally, the hollow handle 410 may be made of a durable, light weight material such as PVC, plastic, nylon, and the like. The hollow handle 410 may an elongate, hollow tube. In addition, the hollow handle 410 may be molded or otherwise formed to include functional, and/or stylistic features. For example, internally, the hollow handle 410 may include internal ribs, rings, extensions, and the like, which are configured to support and/or retain the swivel assembly 420, or portions thereof. Also for example, externally, the hollow handle 410 may include an additional landing area outside of a user gripping area that may be used for advertising or branding. According to one embodiment and as illustrated, the hollow handle 410 may include a portion extending inward of a user grip area that is shaped or otherwise configured to receive a tape or sticker 418 displaying a brand or other messaging.

The hollow handle 410 may also be shaped to include one or more ergonometric features. In particular, the hollow handle 410 may shaped to fit features of the user's hand, providing greater control, comfort, and/or grip. For example, the hollow handle 410 may further include a neck 415 that tapers down from a first outer diameter to a second, smaller outer diameter and back out to a larger diameter. The neck 415 may be positioned to receive a thumb and index finger of the user. In particular, the neck 415 may be located toward the inward end (i.e., inward of a midpoint of the hollow handle 410) of the handle assembly 400. Additionally, the hollow handle 410 may also be shaped to include additional contours corresponding to the user's hand.

According to one embodiment, the neck 415 may include orthogonally disposed pinch points. In particular and as illustrated, an axially inward portion of the neck 415 may include an inward pair of opposing flattened surfaces, and an axially outward portion of the neck 415 may also include an outward pair of opposing flattened surfaces. The opposing flattened surfaces are on opposite sides of the hollow handle 410 relative to a plane normal to its center axis, and correspond to a thumb and an index finger pinching the hollow handle 410. Moreover, the inward and the outward opposing flattened surfaces are rotated ninety degrees from each other, relative to the center axis of the hollow handle 410, providing for two orthogonal grip positions.

According to one embodiment, the hollow handle 410 may include additional gripping features. For example, the hollow handle 410 may include a section wrapped with a tape 416 such as overgrip (conventionally used with sports rackets) or grip tape (conventionally used with golf clubs). It should be understood that any suitable tape (e.g., vinyl tapes) can be used to wrap the handle of the invention. In some embodiments, the wrap is a microfiber, tacky grip material that allows the user to loosen their grip tension on the handles and allows for greater articulation of the exercise jump rope 100 throughout the swing.

Also for example, the hollow handle 410 may include one or more protrusions 417 such as ridges extending radially outward from an outer surface of the hollow handle 410. According to one embodiment, the one or more protrusions 417 may include a single spiral rib, spiraling about its outer surface. In addition, the one or more protrusions 417 may include a circumferential rib or ring at an axially outward end of the hollow handle 410, providing for a last finger grip or end stop for the user's hand. In addition, the one or more protrusions 417 may include an inward circumferential rib or ring at an axially inward end of the single spiral rib and/or axially outward of the neck 415, providing for a grip between the index and middle finger. Moreover, the grip features may be further combined, such as by wrapping the tape 416 over the one or more protrusions 417 on the hollow handle 410.

Within the hollow handle 410, the bearing interface 413 is configured to secure the bearing 421 of the swivel assembly 420 to the hollow handle 410. In particular, bearing interface 413 retains the outer ring radially and axially, while permitting the inner ring to rotate. For example, as above, the hollow handle 410 may include internal ribs, rings, extensions, lips, and the like, extending radially inward and positioned to hold one or more bearings 421 in place. In this way, additional hardware may be avoided, reducing cost, weight, and part count. For example, the bearing interface 413 may include an inner ring within the hollow handle 410 and an outer lip on the inward end the hollow handle 410, wherein the bearing 421 is held in the hollow handle 410 by being popped over the outer lip.

According to one embodiment, the hollow handle 410 may be a pre-fabricated wholesale item, such as a black, PVC handle with samba ball bearings, which are utilized in conjunction with swivel assembly 420. Moreover, as a thermoplastic material, the hollow handle 410 may be subsequently modified to include ergonometric features, such as those discussed above. In addition, ribs, tape, and/or other grip features may be added to the hollow handle 410.

Figure 4:
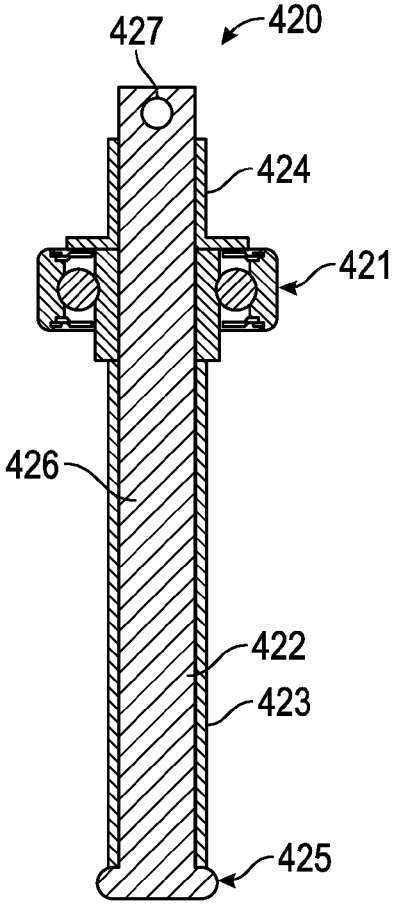
FIG. 4 is a sectional side view bisecting the swivel assembly of the exercise jump rope FIG. 3.

FIG. 4 is a sectional side view bisecting the swivel assembly of the exercise jump rope FIG. 3. The swivel assembly 420 includes the bearing 421, an axis pin 422, and axis pin positioner 423, and an external spacer 424. The swivel assembly 420 is configured to support each end of the cable assembly 200 at the inward end of the handle assembly 400 while allowing it rotate freely. In addition, the swivel assembly 420 provides play about its own rotational axis.

The bearing 421 is configured to carry both radial and axial forces. For example, bearing 421 may be embodied as radial deep groove ball bearing. The radial deep groove ball bearing is a very popular bearing providing for low cost, high performance, and nominal weight. The bearing 421 may be flanged or unflanged. According to one embodiment the bearing 421 may be a samba ball bearing. According to another embodiment, the bearing 421 may be a single shielded bearing, providing for both low cost and high speed. Alternately, the bearing 421 may be double shielded and/or sealed. According to another embodiment, the bearing 421 may be a 608 series bearing. According to another embodiment, the bearing 421 may be a samba bearing ⅜ inch (10.2 mm) long, with an inside diameter of ¼ inch (6.5 mm) and an outside diameter of ⅞ inch (22 mm).

According to one embodiment, the swivel assembly 420 may include a second bearing 421. In particular, the second bearing can be added inside the hollow handle 410 to create greater stability of the axis pin 422 during high velocity rotation. In this configuration, the hollow handle 410 may include a second bearing interface 413. As with the first bearing 421, the hollow handle 410 may include internal ribs, rings, extensions, and the like, extending radially inward and positioned to hold the second bearing 421 in place. However, the second bearing may only need to carry radial forces. For example, the second bearing may be embodied as a plain bearing, such as a bushing or merely an inner portion of the hollow handle 410 that is configured to contact the axis pin 422. According to one embodiment, the second bearing interface 413 may be formed in an inner portion of a neck 415 of the hollow handle 410. According to another embodiment, the second bearing 421 may be an inner portion of a neck 415 of the hollow handle 410 acting as a plain bearing.

The axis pin 422 slots through an inner ring or rotating ring of the bearing 421, and acts as a rotational axis and counter balance to the cable assembly 200. The axis pin 422 may include a head 425, a shaft 426, and cross-hole 427. In particular, the head 425 may be a larger diameter terminal seat at one end of the shaft 426, and the cross-hole 427 may be a hole through the shaft 426 proximate the other end at a 90 degree angle to its rotational or center axis. For example, the axis pin 422 may be embodied as a clevis pin. In addition, the axis pin 422 may be a steel and/or a zinc plated clevis pin. Furthermore, the axis pin 422 may have an outer diameter nominally smaller than an inner diameter of the bearing 421, such that the axis pin 422 may slidably engage the bearing 421 under its own weight (e.g., by tilting and allowing the axis pin 422 to slide into or out of the bearing 421).

According to one embodiment, the axis pin 422 has length greater than 1 inch. According to one embodiment, the clevis pin can be 1½ inches to 2 inches long with a diameter of approximately ¼ inch (6.4 mm), and/or a cross-hole diameter of approximately 3/32 inch (2.4 mm). According to one embodiment, the clevis pin has a length of 1⅞ inches (47.2 mm), an outside diameter of ¼ inch (6.2 mm), an end lip of ⅛ inch (2.5 mm)×⅜ inch (9.5 mm), a cross-hole diameter of ⅛ inch (2.5 mm) and a length-to-head of 3/16 inch (4.2 mm). As will be understood by a skilled artisan, the diameter of the clevis pin can change with the diameter of the inner ring of the bearing 421. In various embodiments, the clevis.

The axis pin positioner 423 is configured to position the majority of the axis pin 422 within the hollow handle 410 and limit the portion of the shaft 426 that extends outside of the hollow handle 410. The axis pin positioner 423 may be an internal spacer such as a bushing or other hollow cylindrical structure made of nylon, PVC, or the like. In this configuration, the axis pin positioner 423 slides onto the axis pin 422 and abuts the terminal seat at one end of the axis pin 422. Accordingly, the axis pin positioner 423 may have the same inner diameter as the bearing 421. In addition, the axis pin positioner 423 extends axially to an internal face of the bearing 421 retaining the majority of the body of the axis pin 422 inside the hollow handle 410, only allowing for approximately ¼ inch (6.4 mm) to ½ inch (12.7 mm) of the axis pin 422 to be exposed on the outside of the hollow handle 410. Also, the axis pin positioner 423 may include a lip or flange at one or both ends.

According to one embodiment, the axis pin positioner 423 may have a length of ¾ inch to 1¼ inches (19 mm to 31.8 mm), an inner diameter of approximately ¼ inch (6.75 mm), and an outer diameter of ⅜ inch (9.5 mm). According to another embodiment, the axis pin positioner 423 may have a length of ⅞ inch (22 mm), an inner diameter of ¼ inch (6.75 mm), and an outer diameter of ⅜ inch (9.5 mm).

The external spacer 424 may similarly be a bushing or other hollow cylindrical structure made of nylon, PVC, or the like. The external spacer 424 slides onto the axis pin 422 and abuts an external face of the bearing 421. Accordingly, the external spacer 424 may have the same inner diameter as the bearing 421. In addition, the external spacer 424 may have the same inner diameter or thickness as the axis pin positioner 423. However, as discussed below the outer diameter or thickness may differ from the axis pin positioner 423 due to functional sizing, for example. The external spacer 424 may also include a lip or flange at one or both ends.

In contrast to the axis pin positioner 423, the external spacer 424 may include a UV protectant and may be made of a more durable material. The inventor has discovered that the inclusion of a UV protectant may inhibit premature wear. According to one embodiment, the external spacer 424 may be a black nylon spacer with UV protection. Also, in contrast to the axis pin positioner 423, the external spacer 424 may have a shorter length of approximately 5/16 inch (8.35 mm).

According to one embodiment, the external spacer 424 may be sized to inhibit interaction and wear between the rotating and non-rotating parts. In particular, in use there is a tendency for the cable to have more of a "V" shape than a "U" shape, and thus the cable assembly 200 and the cable connector 300 may cut back toward the handle, creating wear. Here, the inventor has discovered that the external spacer 424 may be sized so as to take up the wear first and to inhibit further wear and interaction with the rest of the handle assembly 400. For example, the external spacer 424 may be relatively sized, such that the external spacer 424 extends axially from an external face of the bearing 421 up to the cross-hole of the axis pin 422. Also for example, the external spacer 424 may be sized, such that the external spacer 424 extends axially from an external face of the bearing 421 and covers a portion of the cross-hole.

Alternately, the external spacer 424 may be functionally sized, such that the external spacer 424 limits the free movement of the cable connector 300. In particular, the external spacer 424 may have an axial length such that cable connector 300 is inhibited from rotating (flipping) about a center axis of the cross-hole of the axis pin 422. This functional sizing may include the axial length and the outside length. For example, the external spacer 424 may have an axial length and outside diameter such that cable connector 300 is inhibited from rotating more than 180 degrees about the center axis of the cross-hole. Also for example, the external spacer 424 may have an axial length and outside diameter such that cable connector 300 is inhibited from rotating more than 240 degrees about the center axis of the cross-hole, or in the alternate, more than 30 degrees in inward direction 101 from a plane normal to a rotation axis of the bearing 421.

To illustrate the assembly of the exercise jump rope 100 and referring to FIG. 1-FIG. 4, according to one exemplary embodiment, the samba ball bearing 421 is popped into the PVC hollow handle 410 over a lip 413 at the outward end opening 412. The clevis pin 422 is fitted with a 1 inch long plastic/nylon bushing 423 that slides all the way to the seat end 425 of the clevis pin 422. The clevis pin 422 is then inserted into the PVC hollow handle 410 through the tail end 411 with the end cap 415 removed, and the end cap 415 is subsequently replaced. The clevis pin 422 then slots through the samba ball bearing 421 and protrudes out of the hollow handle 410 approximately ½ inch. A ¼ inch nylon/plastic bushing 424 is then placed over the exposed end of the clevis pin 422 revealing a 3/32 inch cross-hole 427 proximate the exposed tip of the clevis pin 422. Then a ⅜ inch nickel plated split ring 300 is attached to the clevis pin 422 through the 3/32 inch cross-hole 427. Steel cable rope 210 is then slotted through the split ring 300 on the clevis pin 422, forming a loop 231, and crimped to itself with an aluminum swage 232. The second handle assembly 400 is similarly assembled and coupled to the cable assemble 200. This process may be repeated on alternate pairs of handle assemblies 400 utilizing 1/16 inch to 5/32 inch steel cable with PVC/nylon coating.

In operation, in this embodiment, the clevis pin 422 acts as the main axis and attachment point to the steel cable rope 210. The 1" long plastic/nylon bushing acts as a spacer to limit the exposure of the clevis pin on the exiting side of the ball bearing casing while retaining the majority of the body inside the jump rope handle. The ¼" nylon bushing acts as spacer to keep the attachment point of the clevis pin 422 and the ⅜ inch nickel plated split ring 300 away from the handles to avoid friction. The ⅜ inch nickel plated split ring 300 acts as an additional hinge joint between the 3/32 inch cross-hole 427 and swaged loop end attachments 230 of the steel cable rope 210. This allows for greater mobility of the steel cable rope 210 through the rotational movement around the user. The aluminum swage 232 acts as a permanent crimp to retain the steel cable rope 210 to the ⅜ inch nickel plated split ring 300.

According to one embodiment, an existing jump rope may be retrofit to include features of the presently disclosed exercise jump rope 100. In particular, a preexisting jump rope having a handle that is hollow with a removable end cap to gain access to the inner part of the handle and has a ball bearing casing with an opening ranging from ⅜ inch to ¾ in diameter may be retrofit to include the swivel assemble 420 and coupled to the cable assembly 200 disclosed above. For example, the parts would then be assembled by first removing the end cap of each jump rope handle. The 1 inch plastic spacer would then be placed onto the clevis pin and slid all the way to the seat end of the pin. The clevis pin is then dropped into the open end of the handle until the free end of the clevis pin is exposed out the other side of the handle through the ball bearing casing. A ¼ inch nylon bushing is then placed over the exposed end of the clevis pin. A ⅜ inch nickel plated split ring is then attached to the predrilled hole on the exposed end of the clevis pin. Then any of various thickness steel cables is slotted through the split ring, looped around and then crimped to itself with the aluminum swage. This process is repeated with both jump rope handles at either end of the PVC nylon coated steel cable.

The present disclosure provides many benefits. In particular, benefits realized from an exercise jump rope made in accordance with the present disclosure include reduced cost, ease of assembly/maintenance, durability, and ease of component supply. For example, many of the components used in the exercise jump rope are readily available within the aircraft and marine industry as well as other sports.

In addition to the availability and lower cost of durable, off-the shelf components, the assemblies of the exercise jump rope, combined with the high grade materials used, may provide for vastly improved performance. For example, the present disclosure relates to a swivel/axis assembly for a cable jump rope used in any hollow jump rope handle with a samba sealed ball bearing for fitness training.

The swivel/axis mechanism gains usefulness by way of a connecting rod that extends distally from the cable connection into the handle bearing housing. Doing so allows the cable rope to rotate freely about its own axis without excessive friction and or mechanical interference at the handles while increasing the degrees of freedom about which the rope rotates. The distal end extending beyond the bearing surface into the handle housing provides a counter balance and a secondary bearing surface which while acting in plurality with the first bearing surface results in a greater response to user input while providing higher user sensitivity and overall superior performance. In addition, the proximal connection of the connection rod to the cable allows the cable rope to rotate about an axis perpendicular to the handle axis improving the user control during rotation and an optimal profile of the cable throughout its rotational path.

Performance is further enhanced through the exercise jump rope's multi-linkage couplings. In particular, the 3-piece linkage assembly between the clevis pin 423, the split ring 300 and the cable loop 231 may provide superior performance of the apparatus. This unique design allows for the multiple degrees of freedom in rotation, regardless of the user's wrist action or wrist flexibility. In contrast traditional linkage assemblies typically embodied 2 designs: (1) A straight alignment connection wherein the cord connects directly into the handle at a parallel relationship to the handle (however, this version of linkage lacks the control and whipping action prevalent in our 3 linkage embodiment); and (2) A 90-degree attachment (commonly associated with Speed Ropes) in which the cable connects into the handle at a rigid 90 degree angle to the handle (however, this version of linkage promotes a rigid style of wrist action adapted for speed but lacks the versatility for slower styles of jumping or styles of jumping where a more relaxed, disengaged wrist is appropriate). Because this swivel mechanism allows for increased speed and also utilizes various weighted cable rope it dramatically increases the user's potential for prolonged exercise while jumping rope and consequently improve cardio respiratory capacity. Moreover, there currently is not a swivel mechanism utilizing an axis point in conjunction with the ball bearing handles while extending deep into the handle acting as a counter balance.

Existing swivel systems are all top end loaded and encased beyond where the hand grips the handles. By utilizing the 2 inch clevis pin, the action of the spinning is moved toward the middle of the handles and closer to the palm of the hands where the user has a stronger grip and also greater articulation of the rope. The clevis pins, in conjunction with the samba ball bearings, also creates a near friction free spinning superior to all other swivels.

This design is also a dramatic improvement in durability since the materials used are industrial grade materials such as steel clevis pins, nylon/PVC coated steel cable, aluminum swages, and nylon/PVC bushings. These materials are proven to be more durable and increase the life span of the jump rope over the versions currently on the market.

In addition, the inventor is unaware of any other jump rope manufacturer using microfiber, tacky grip material to wrap the handles, similar to a tennis racket. The use of this material allows the user to loosen their grip tension on the handles and allows for greater articulation of the jump rope throughout the swing. Notwithstanding and despite widespread use in other sports, no other jump rope manufacturer is wrapping the handles with a similar grip material.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. For example, the exercise jump rope is illustrated with features such a hollow handle including a neck and a single bearing coupled with a steel cable rope with a split ring. However, there in other embodiments the exercise jump rope may a simple tubular handle or a curved handle configured for a particular hand position. Likewise, the exercise jump rope may include a second bearing in the handle. Also, the cable may be made of another material and/or the cable connector may utilize a different type of quick release mechanism. Thus, the invention is not intended to be limited to the embodiments shown herein but is to be accorded the widest scope consistent with the principals and novel features disclosed herein. It is also understood that the illustrations may include exaggerated dimensions and graphical representation to better illustrate the referenced items shown, and are not consider limiting unless expressly stated as such.

What is claimed is:

1. An exercise jump rope comprising:

a cable assembly including a cable, a first and a second end attachment at a first end and a second end of the cable, respectively;

a first and a second cable connector coupled to the first and the second end attachment, respectively;

a first and a second handle assembly coupled to the first and the second cable connector, respectively, each handle assembly including a hollow handle and a swivel assembly, each hollow handle configured to house and retain the swivel assembly and configured to permit a rotating portion of the swivel assembly to extend out from the hollow handle, each swivel assembly including a bearing configured to carry radial and axial forces fixed to the hollow handle, an axis pin having a head and a cross-hole and rotatably coupled to the bearing, an axis pin positioner configured to position a majority of the axis pin within the hollow handle, and an external spacer about the axis pin, the external spacer abutting an external face of the bearing.

2. The exercise jump rope of claim 1, wherein external spacer have an axial length such that cable connector is inhibited from rotating more than 240 degrees about a center axis of the cross-hole of the axis pin.

3. The exercise jump rope of claim 1, wherein the hollow handle includes at least one or more protrusions extending radially outward from an outer surface of the hollow handle providing for a last finger grip for the user's hand.

4. The exercise jump rope of claim 1, wherein the cable is a steel wire rope;

wherein the first and the second end attachments are swaged loops including portions of the first end and the second end of the cable, respectively; and wherein the cable assembly further includes a cover about the cable, the cover extending between the first and the second end attachments.

5. The exercise jump rope of claim 1, wherein the cable has a unit weight for a 9 foot length of approximately 1.3 ounces, 1.8 ounces, 2.6 ounces, 3.4 ounces, 4.1 ounces, or 8.6 ounces.

6. The exercise jump rope of claim 1, wherein the cable is a coated 1×19 stainless steel cable approximately between 1.3 ounces and 1.8 ounces for a 9 foot length allowing the cable to maintain its shape and create a fast cycle rate to build coordination and speed while extracting the quick twitch muscle fibers.

7. The exercise jump rope of claim 1, wherein the cable has a unit weight of 2.6 ounces for a 9 foot length to produce a more controlled experience with a light, fast cycle rate while creating increased feedback and rigidity.

8. The exercise jump rope of claim 1, wherein the first and the second cable connector each include a split ring.

9. A handle assembly for an exercise jump rope, the handle assembly comprising:

a swivel assembly including a bearing, an axis pin, and an axis pin positioner;

a hollow handle shaped to fit the features of the users hand providing greater control, comfort and grip and configured to house the swivel assembly;

the bearing being a radial deep groove ball bearing fixed to the hollow handle;

an axis pin having a head at one end and a cross-hole proximate an opposite end, the axis pin rotatably coupled to the bearing;

an axis pin positioner configured to position a majority of the axis pin within the hollow handle; and an external spacer about the axis pin abutting an external face of the bearing.

10. The handle assembly of claim 9, wherein the hollow handle is an elongate, hollow tube having a first outer diameter and including a neck that tapers down from the first outer diameter to a second, smaller outer diameter and back out to a larger diameter.

11. The handle assembly of claim 10, wherein an axially inward portion of the neck includes an inward pair of opposing flattened surfaces, and an axially outward portion of the neck includes an outward pair of opposing flattened surfaces.

12. The handle assembly of claim 10, wherein the hollow handle includes at least one of a section wrapped with a tape where the tackiness and surface promotes traction between the fingers allowing the user to grip, and further including protrusions to secure the radial and axial forces placed on the handle.

13. The handle assembly of claim 9, wherein the bearing is configured to carry both radial and axial forces, handle assembly further comprising a second bearing inside the hollow handle and configured to carry radial forces.

14. The handle assembly of claim 9, wherein the axis pin has length greater than 1 inch.

15. The handle assembly of claim 9, wherein the axis pin has an outer diameter nominally smaller than an inner diameter of the bearing, such that the axis pin may slidably engage the bearing under its own weight.

16. The handle assembly of claim 15, wherein the hollow handle includes a removable end cap covering an inward end opening.

17. The handle assembly of claim 9, wherein the axis pin positioner is a hollow cylindrical structure which slides onto the axis pin and abuts a terminal seat at one end of the axis pin and extends axially to an internal face of the bearing.

18. The handle assembly of claim 9, wherein the external spacer is a hollow cylindrical structure which slides onto the axis pin abuts the external face of the bearing, and extends axially at least up to the cross-hole.

19. The handle assembly of claim 18, wherein the external spacer is made of PVC or nylon and includes UV protection.

20. The exercise jump rope of claim 1, wherein the cable has a unit weight of 3.4 ounces for a 9 foot length coated to 5/32 and 3/16 outer diameter which provides tremendous feedback through increased resistance allowing the athlete to jump with a broader range of tempos.

21. The exercise jump rope of claim 1, further comprising a second bearing inside the hollow handle to create greater stability of the axis pin during high velocity rotation.

22. The exercise jump rope of claim 1, further comprising a length which is three feet plus the height of the user.

* * * * *